United States Patent [19]

Dustmann et al.

[11] Patent Number: 4,745,367

[45] Date of Patent: May 17, 1988

[54] SUPERCONDUCTING MAGNET SYSTEM FOR PARTICLE ACCELERATORS OF A SYNCHROTRON RADIATION SOURCE

[75] Inventors: Cord-Henrich Dustmann; Hubert Keiber, both of Weinheim; Berthold Krevet, Dettenheim, all of Fed. Rep. of Germany

[73] Assignees: Kernforschungszentrum Karlsruhe GmbH, Karlsruhe; Brown, Boveri & Cie AG, Mannheim, both of Fed. Rep. of Germany

[21] Appl. No.: 845,889

[22] Filed: Mar. 28, 1986

[30] Foreign Application Priority Data

Mar. 28, 1985 [DE] Fed. Rep. of Germany ..... 3511282

[51] Int. Cl.[4] ..... H05H 7/04; H05H 13/04

[52] U.S. Cl. ..... 328/235

[58] Field of Search ..... 313/62; 328/233, 235

[56] References Cited

U.S. PATENT DOCUMENTS

| | | | |
|---|---|---|---|
| 3,128,405 | 4/1964 | Lambertson | 328/235 |
| 3,303,426 | 2/1967 | Beth | 328/235 |
| 4,641,057 | 2/1987 | Blosser et al. | 328/235 X |

OTHER PUBLICATIONS

"Technical Report of ISSP (The Institute for Solid State Physics)", The University of Tokyo, Sep. 1984, Ser. B., No. 21, Publ. -Nr. ISSN 0082,4798 Title: Superconducting Racetrack Electron Storage Ring and Coexistent Injector Microtron for Synchrotron Radiation, Editors: Y. Miyahara, K. Takata, T. Nakanishi; pp. 21 to 29.

Proceedings "The Third International Conference on Magnet Technology" (MT3), Hamburg 1970 (Published by the 'Deutschen Elektronen-Synchrotrons DESY'), pp. 719 to 720, 757 to 767.

Proceedings of the 8th International Conference on High Energy Accelerators", Geneva, Sep. 20th to 24th, 1971, pp. 35 to 50.

"Physik in unserer Zeit", 16th year 1985, Nr. 1, pp. 16 to 23.

*Primary Examiner*—David K. Moore
*Assistant Examiner*—K. Wieder
*Attorney, Agent, or Firm*—Herbert L. Lerner; Laurence A. Greenberg

[57] ABSTRACT

A superconducting magnet system for particle acceleration of a synchrotron radiaton source having a particle orbit in a given plane includes a superconducting winding surrounding the particle orbit and having a slot formed therein in the given plane of the particle orbit for egress of synchrotron radiation, the superconducting winding having a cos $\theta$ shaped current distribution, where $\theta$ is the azimuth angle, and a mechanical support for the superconducting winding including at least one clamping element pre-tensioning the superconducting winding, and tightening elements in the vicinity of the slot pre-tensioning the superconducting winding in cooperation with the at least one clamping element.

15 Claims, 3 Drawing Sheets

SUPERCONDUCTING MAGNET SYSTEM FOR PARTICLE ACCELERATORS OF A SYNCHROTRON RADIATION SOURCE

The invention relates to a superconducting magnet system for particle accelerators of a synchrotron radiation source, having a slot which lies approximately in the plane of the particle orbit and is tangentially or radially open for the egress of synchrotron radiation, and a mechanical support device for the superconducting winding.

Such a magnet system is known from German Published, Non-Prosecuted Application DE-OS No. 31 48 100 or from the publication "Nuclear Instruments and Methods", vol. 200, 1982, pages 475 to 479.

In order to construct an accelerator for a compact synchrotron radiation source, it is necessary to make a transition from normally conducting deflection magnets for deflecting a beam of charged particles (such as electrons), to superconducting magnet systems with which the required magnetic field intensities can be achieved. The requirements of such a magnet system, as they are met by the known magnet system, can be summarized as follows:

(a) Generation of a magnetic field with the field gradient n, such that $$n = -\frac{r_o}{B_o} \cdot \frac{\partial B}{\partial r}\bigg|_{r_o},$$

wherein the field index in this case is smaller than 1;

$r_o$ is the desired radius of the particle orbit;

B is the magnetic induction; and $\partial B/\partial | r_o$ is the derivative of the induction with respect to the particle radius at the location of the desired radius $r_o$.

(b) The windings of the magnet system must be disposed in such a way that the generated synchrotron radiation can leave the magnet system tangentially in the plane of the orbit of the particles.

The coil configuration used by the conventional magnet system has a rectangular winding cross section and permits the tangential egress of the radiation. The energy stored in the magnetic field is greater for such configurations than for a comparable shell configuration. This large amount of stored energy must be decoupled from the coil in the event of quenching, i.e., in the event of an unintended transition from the superconducting to the normally conducting phase, in order to prevent the destruction of the coil due to the heavy heating and the mechanical stresses connected therewith. In addition, the above-mentioned coil configuration requires a comparatively greater amount of conductor material in order to provide the necessary magnetic field.

Superconducting reflection magnets are also used in the construction of large ring accelerators (e.g. HERA). Essential details of these magnets are described in published papers by G. Horlitz et al entitled "Superconducting Prototype Dipole Coils for HERA" and "Alternatives and Improvements for Superconducting Dipole Coils for HERA", in the Journal de Physique, Conference C1, supplement to No. 1, Volume 45, January 1984, pages C1-255 to C1-262. The coil configuration used in such a device has a shell-shaped winding cross section and a substantially cos $\theta$ shaped current distribution. The current distribution is developed for the generation of a dipole field within the winding configuration.

The decisive element of this configuration is a clamp which applies a pretension to the superconducting coil. The basic idea of the pretensioning principle is to compress the coil stack in the currentless state with clamping elements, to such an extent that with the coil fully energized, the superconducting winding is supported with the stiffness of the clamping element. This is necessary in order to prevent movement of the conductors and therefore quenching. However, such a shell-shaped coil configuration with clamping elements, does not permit tangential egress of the synchrotron radiation with respect to the curvature of the particle orbit, since the particle orbit is surrounded on all sides by a vacuum tube and the surrounding coil configuration is surrounded with clamping elements.

Dispensing with the clamping elements also cannot provide relief in this case. While a superconducting deflection magnet with vacuum-pressure impregnation which has sufficient strength could be used, such magnets exhibit an undesirable "training behavior", i.e., the coil cannot be operated immediately with maximum load, it must rather be "trained" by exciting it up to a quenching which initially occurs far below the maximum load. During the training, the conductors move into mechanically stable positions, so that for subsequent excitations, quenching occurs at higher and higher current values.

It is accordingly an object of the invention to provide a superconducting magnet system for particle acceleration of a synchrotron radiation source, which overcomes the hereinafore-mentioned disadvantages of the heretofore-known devices of this general type, which has a low magnetic energy content, which requires little conductor material and which has a structure that avoids a vacuum-pressure impregnation which is unfavorable with respect to the training behavior With the foregoing and other objectsin view there is provided, in accordance with the invention, a superconducting magnet system for particle acceleration of a synchrotron radiation source having a particle orbit in a given plane, comprising a superconducting winding surrounding the particle orbit and having a radially or tangentially open slot formed therein in the given plane of the particle orbit for egress of synchrotron radiation, the superconducting winding having a cos $\theta$ shaped current distribution, where $\theta$ is the azimuth angle, and a mechanical support for the superconducting winding including at least one clamping element pretensioning the superconducting winding, and tightening elements in the vicinity of the slot pretensioning the superconducting winding in cooperation with the at least one clamping element.

The at least one clamping element can form a structural element together with at least one of the tightening elements which support the superconducting winding in the vicinity of the slot. However, it is advantageous for assembly reasons if the clamping elements and the tightening elements are separate components which are connected to each other in a force-locking manner. A force-locking connection interconnects parts with external force, as opposed to a form-locking connection which is formed by the shapes of the parts themselves.

The advantages achieved with the invention are essentially seen in the fact that the pretensioning principle used in the construction of dipole coils can be applied to C-magnets, in that the part of the winding pointing toward the opening of the magnet system can be tightened. Vaccum-pressure impregnation of the superconducting coils can therefore be avoided.

In accordance with another feature of the invention, the superconducting winding has a shell structure. In this case the coil is fabricated from several concentric cylindrical shells. Within each shell, winding stacks are accomodated between two azimuth angles $\theta$. The advantage of this configuration is the small amount of magnetic energy as compared to the rectangular winding configuration.

In accordance with a further feature of the invention, the superconducting winding has a block structure. This structure also exhibits the advantages of the shell structure. A block structure which is suitable in principle is described in the publication by H. Brechna, entitled "Superconducting Magnet Systems", Springer Publishers, Berlin, Heidelberg, N.Y. (1973), page 40, FIG. 2.1.6*a*. However, it would be necessary for the embodiment according to the invention to provide a slot located radially outwardly in the plane (x-axis) of the particle orbit.

The tightening element can advantageously be constructed in the form of a hook, with a first leg supporting the superconducting winding in the vicinity of the slot and being hung with a second leg in the clamp which substantially includes the entire winding configuration.

In accordance with an added feature of the invention, the superconducting winding includes winding parts, and at least one of the tightening elements is fastened to the at least one clamping element and has a free leg in the vicinity of the slot supporting the winding parts disposed in the vicinity of the slot.

In accordance with an additional feature of the invention, each of the tightening elements is substantially U-shaped and includes another free leg, the at least one clamping element and the parts of the superconducting winding in the vicinity of or facing the slot being tightened between the free leg of the tightening elements.

In accordance with again another feature of the invention, the superconducting winding includes winding parts, and each of the tightening elements has a substantially U-shaped cross section, an inner part pushed against the winding parts facing the slot, two free legs tightened against the at least one clamping element, and a base leg extending in the vicinity of the slot.

In accordance with again a further feature of the invention, there are provided tension bolts attached to ends of the free legs of the tightening elements for tightening the free legs against the at least one clamping element.

In accordance with again an added feature of the invention, the tightening elements have another leg corresponding to the base leg and supporting the winding parts of the superconducting winding opposite the winding parts facing the slot, with respect to the particle orbit. This supplements the U-shaped profile in part, to form a W-shaped profile. However, the third free leg is only provided in part or not at all. The second free base leg engages below the winding part which is located in the plane of the curved particle orbit and on the side of the center of the curvature of the orbit.

The tightening element is constructed in such a way that it can take up the attraction forces of the opposite coil halves directed toward the plane of the particle orbit with the magnetic field switched on, and can at the same time transmit the required pretension to the winding parts in order to preclude conductor movements.

Besides the transmission of the pre-tension, in accordance with again an additional feature of the invention, the tightening elements are part of a helium container for enclosing the superconducting winding. Material can be saved in this manner particularly in the vicinity of the slot, which facilitates the mechanical construction in the vicinity of the slot.

If a winding configuration is to be used which can be operated as an air-core coil, the clamping elements and/or the tightening elements are preferably made of non-magnetic material, such as non-magnetic steel.

In accordance with yet another feature of the invention, the at least one clamping element and/or the tightening elements are in the form of a magnetic yoke.

When dealing with a high pulse rate, a laminated structure of the clamping elements and/or tightening elements is preferred. For magnet systems with constant or slowly changing magnetic field intensity, the clamping elements and the tightening elements can be a solid yoke. In this case, a structural unit formed of the tightening elements and the cryo container is particularly advantageous.

In accordance with a concomitant feature of the invention, there is provided a particle channel, the slot having a width matched to the superconducting winding generating a dipole field and a quadrupole field in the particle channel having a focusing effect on the particle beam. The slot can be enlarged by optimizing this relationship, so that more space is available for the tightening elements.

Another advantageous embodiment of the invention is that the superconducting winding is constructed as a winding which is transparent to helium, i.e., the insulation is laid out in such a way that helium can penetrate into the winding between the conductors and can thereby provide intensive cooling of the conductors.

Other features which are considered as characteristic for the invention are set forth in the appended claims.

Although the invention is illustrated and described herein as embodied in a superconducting magnet system for particle accelerators of a synchrotron radiation source, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
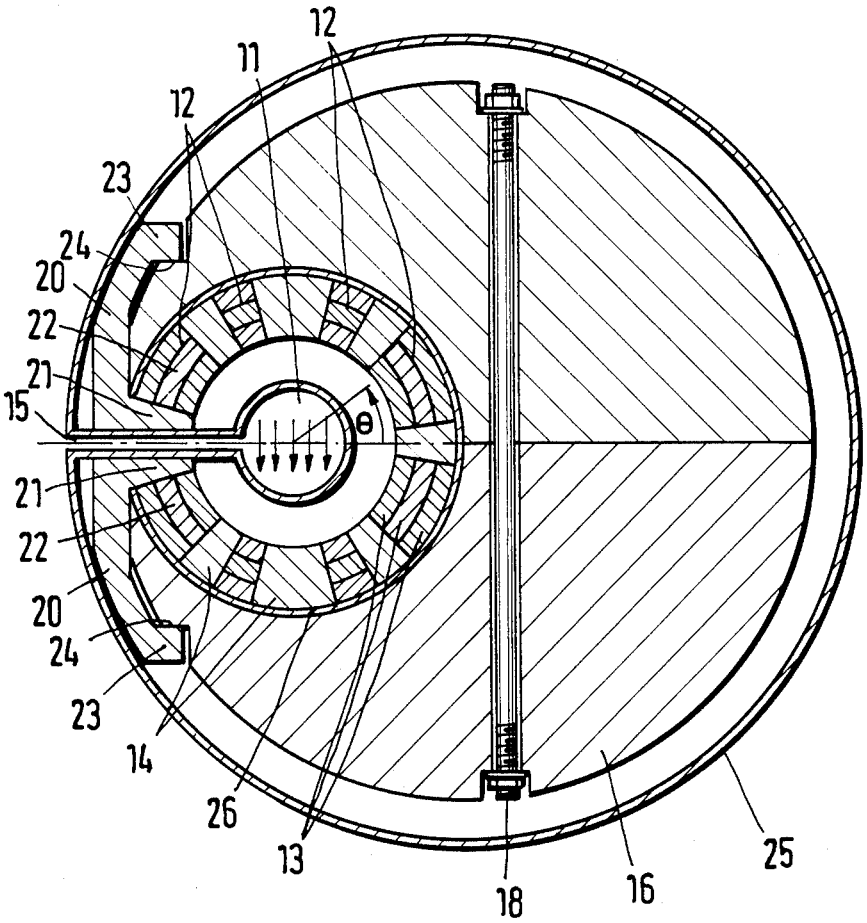
FIG. 1 is a diagrammatic, cross-sectional view of a first embodiment of the magnet system of the invention with hook-shaped tightening elements.

Referring now to the figures of the drawings in detail and first, particularly, to FIG. 1 thereof, there is seen a cross section of a superconducting magnet system which generates a magnetic field in a particle channel 11 which substantially represents a dipole field, with field lines extending in the direction of $\theta=270°$. A superconducting winding 12 is fabricated from several concentric cylindrical shells 13. Winding stacks are accomodated within each shell 13, between two respective azimuth angles $\theta$. The winding stacks are formed of individual conductors extending perpendicularly to the plane of the drawing. Non-magnetic filler material 14 is disposed between the winding stacks. This winding configuration results in a substantially cos $\theta$ shaped current distribution and is suitable for generating a dipole field. The winding configuration has the advantage of having less magnetic energy as compared to a rectangular winding configuration.

Figure 2:
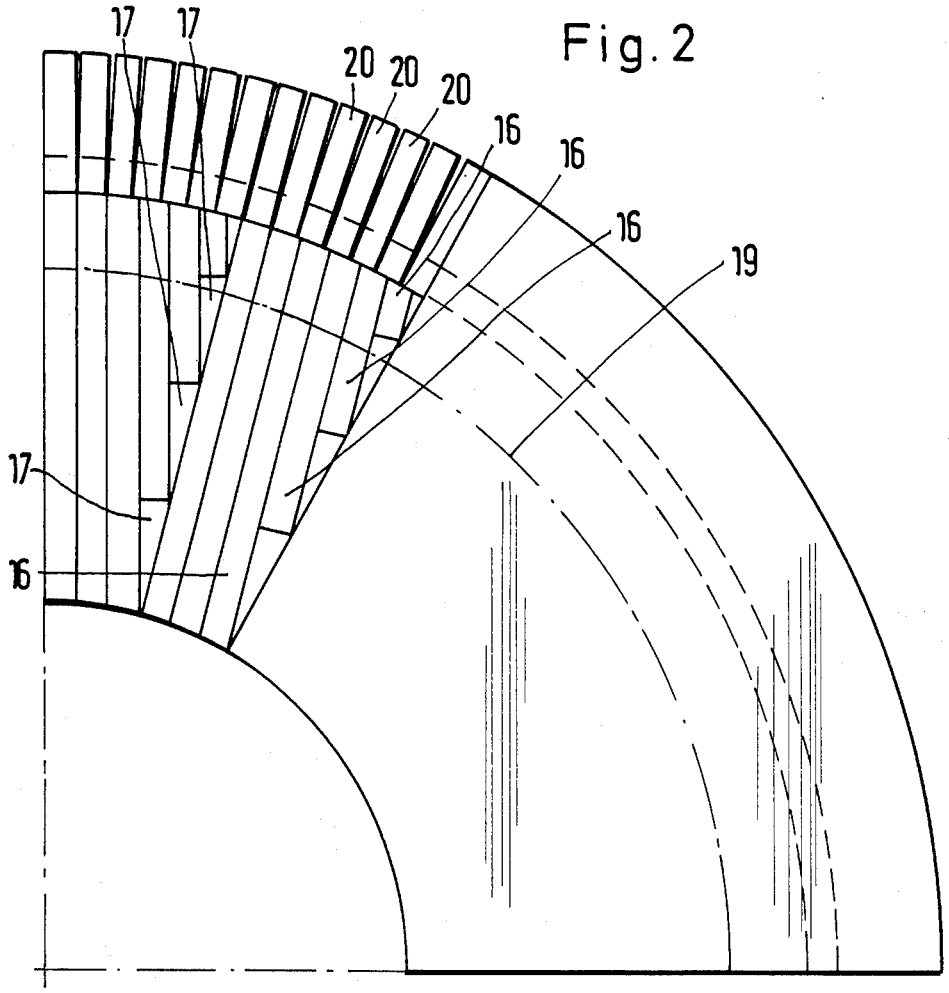
FIG. 2 is a top-plan view of a magnet system according to FIG. 1.

Electrons which move along the particle channel 11 extending perpendicular to the plane of the drawing, are deflected due to the Lorentz force and are forced into a circular path or orbit 19, seen in FIG. 2. In the process, they give off synchrotron radiation in a tangentially outward direction (to the left in FIG. 1). The synchrotron radiation can be led from the particle channel 11 laterally through a slot 15 and is available for physical experiments or technical applications.

Within the superconducting winding 12, forces occur if the coil is energized, which can lead to conductor movements. Therefore, the winding configuration is compressed by clamping elements 16 and pre-tensioned to the extent that even with the coil fully energized, the superconducting winding 12 is supported with the stiffness of the clamping elements 16.

As can be seen from FIG. 2, the clamping elements 16 are formed of stamped magnet laminations which are stacked together to form a magnetic yoke. The magnetic yoke has the shape of a cylinder which is composed of two halves bent in a circular shape and forming a 90° arc. In order to compensate for the curvature of the configuration, laminations with different dimensions are required for the stacking of the magnetic lamination, between which spaces 17 that are filled with helium coolant are formed In order to avoid the spaces 17, laminations which are stamped in a wedge shape can also be used; however, they are substantially more expensive to manufacture than sheet metal material of equal thickness, as shown. The laminations are welded together to form a unit.

The two yoke halves are connected to each other by tie rods or stays 18. The tightening force of the tie rods 18, which can be supplied by means of hydraulic pressing devices, generates the pressure required for pre-tensioning the superconducting winding 12.

In the vicinity of the slot 15, the superconducting winding 12 is supported by tightening elements 20. The tightening elements 20 are also constructed as laminations and supplement the yoke effect of the clamping elements 16. The tightening elements 20 are essentially U-shaped and have a free leg 21 which grips below a free part 22 of the winding 12 with the shell-shaped winding cross section 13, that faces toward the slot 15. Another free leg 23 grips behind a step-shaped recess 24 in the clamping element 16. The tightening elements 20 are pre-tensioned when they are inserted. Thus, they fulfill their task of transmitting the forces of the coil to the yoke.

The superconducting winding 12, the clampingelements 16 and the tightening elements 20 are surrounded by a vessel wall 25 within which liquid helium is disposed. The particle channel 11, the slot 15 and the region outside the container wall 25 are evacuated.

Cold shields on the outside and an outer vacuum jacket are not shown in FIG. 1. The legs 21 of the clamping elements 20 facing the slot 15 are welded to the container wall 25. They thus serve for stiffening the container wall 25 in the vicinity of the slot 15.

An insulation layer 26 is disposed between the winding 12 and the clamping elements 16. The thickness of the insulating layer 26 is selected by means of magnetic field calculations, in such a manner that the field homogeneity in the particle channel 11 is not adversely affected by saturation phenomena in the material of the clamping elements 16 or the tightening elements 20. The insulation layer 26 is a non-magnetic intermediate material, such as filled plastic.

Figure 3:
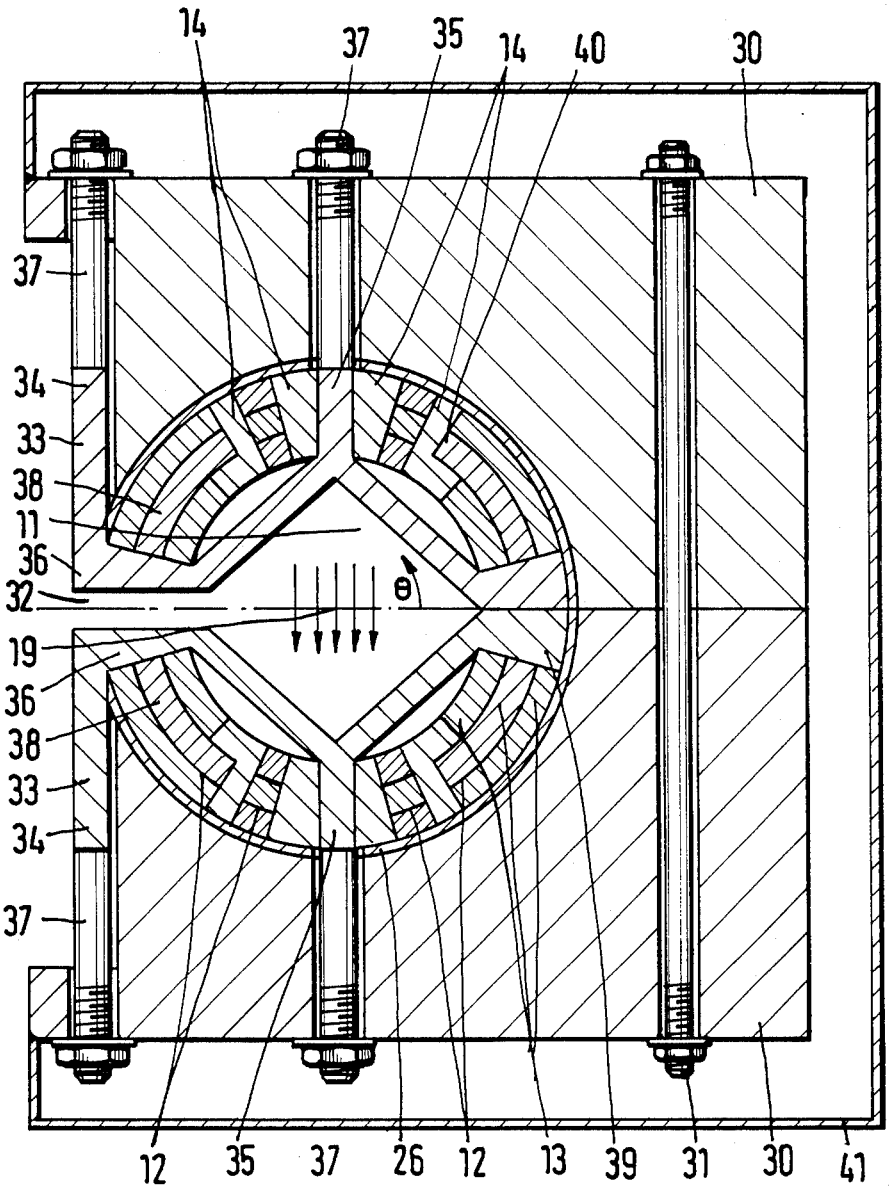
FIG. 3 is a cross-sectional view of a second embodiment of the magnet system with tightening elements which have a substantially W-shaped cross section.

FIG. 3 shows another embodiment of the invention in which the same or similar parts are provided with the same reference numerals as in FIG. 1 and FIG. 2.

The superconducting winding 12 in FIG. 3 is comparable to that shown in FIG. 1 and it surrounds a particle channel 11. The individual stacks of the winding 12 are separated from each other by non-magnetic filling pieces 14. The winding 12 is surrounded by an insulating layer 26, the configuration of which must meet the same requirements as were explained in the description of FIGS. 1 and 2.

The winding with the structure of the shell 13 is surrounded by a bipartite clamping element 30 formed of non-magnetic material, the two parts of which are connected to each other by tie rods 31. The external shape of the clamp elements 30 is substantially that of a circular ring section with a rectangular cross section. For instance, this may be a quarter circle as shown in FIG. 2, or a semicircle of the ring.

In the vicinity of a slot 32 and in the interior of the winding configuration are two tightening elements 33, symmetrically disposed relative to the slot 32 The tightening elements are formed of non-magntic material with a substantially W-shaped cross section. The tightening elements 33 are turned or machine parts, the axes of rotation of which coincide with the center of curvature of a particle path or orbit 19. Welded to an outer free leg 34 and a central free leg 35 of the W-profile are tension bolts or stay rods 37 connecting and tightening element 33 to the clamping element 30. During tightening, a base leg 36 of the W-profile which is situated between the free legs 34 and 35 is pushed against winding parts 38 pointing toward the slot 32, so that the required pre-tension is transmitted to the superconducting winding.

The cross section of the tightening element 33 has another free leg 39 supplementing the cross section of the tightening element, forming approximately a W-shape. A third free leg 39 which is situated inside the particle orbit 19, is not symmetrically constructed relative to the outer free leg 34, but rather engages under a part 40 of the winding 12 pointing to the center of curvature of the particle path or orbit 19. Such a construction of the tightening element 33 results in an advantageous division of the forces.

The magnet system is surrounded by a container wall 41, in the interior of which the coolant is again enclosed. The container wall 41 is welded to the tightening elements 33 so that the tightening elements serve as part of the cryo jacket in this case as well. External cold shields and the vacuum jacket are also not shown in FIG. 3.

The foregoing is a description corresponding in substance to German Application Pat. No. 35 11 282.4, filed Mar. 28, 1985, the International priority of which is being claimed for the instant application, and which is hereby made part of this application. Any material discrepancies between the foregoing specification and the afore-mentioned corresponding German application are to be resolved in favor of the latter.

We claim:

1. Superconducting magnet system for particle accelerators of a synchrotron radiation source having a particle orbit in a given plane, comprising a superconducting winding surrounding the particle orbit and having a slot formed therein in and symmetrical to said given plane of the particle orbit for egress of a synchrotron radiation, said superconducting winding being in the form of a circular cylinder having a circular cross section, each point along said circular cross section being described by polar coordinates of radius r and azimuth angle $\theta$ having a current distribution $I(\theta)=I_\theta \cos n\ \theta$, where $n=1,2,3 \ldots$, and a mechanical support for said superconductiing winding including at least one clamping element pre-tensioning said superconducting winding, and tightening elements in the vicinity of said slot pre-tensioning said superconducting winding in cooperation with said at lest one clamping element.

2. Magnet system according to claim 1, wherein said superconducting winding has a shell structure.

3. Magnet system according to claim 1, wherein said superconducting winding has a block structure.

4. Magnet system according to claim 1, wherein said superconducting winding includes winding parts, and at least one of said tightening elements is fastened to said at least one clamping element and has a free leg in the vicinity of said slot supporting said winding parts disposed in the vicinity of said slot.

5. Magnet system according to claim 4, wherein each of said tightening elements is substantially U-shaped and includes another free leg, said at least one clamping element and said parts of said superconducting winding in the vicinity of said slot being tightened between said free legs of said tightening elements.

6. Magnet system according to claim 1, wherein said superconductin winding includes winding parts, and each of said tightening elements has a substantially U-shaped cross section, an inner part pushed against said winding parts facing said slot, two free legs tightened against said at least one clamping element, and a base leg in the vicinity of said slot.

7. Magnet system according to claim 6, including tension bolts attached to ends of said free legs of said tightening elements for tightening said free legs against said at least one clamping element.

8. Magnet system according to claim 6, wherein said tightening elements have another leg corresponding to said base leg and supporting said winding parts of said superconducting winding opposite said winding parts facing said slot, with respect to the particle orbit.

9. Magnet system according to claim 1, wherein said tightening elements are part of a helium container for said superconducting winding.

10. Magnet system according to claim 1, wherein said at least one clamping element is in the form of a magnetic yoke.

11. Magnet system according to claim 1, wherein said tightening elements are in the form of a magnetic yoke.

12. Magnet system according to claim 1, wherein said at least one clamping element and said tightening elements are in the form of a magnetic yoke.

13. Magnet system according to claim 1, including a particle channel, said slot having a width matched to said superconducting winding generating a dipole field and a quadrupole field in the particle channel having a focusing effect on the particle beam.

14. Magnet system according to claim 1, wherein said winding device is in the form of a straight circular cylinder.

15. Magnet system according to claim 1, wherein said winding device is in the form of a circular cylinder partially toroidally bent along a 90 ° arc.

* * * * *

UNITED STATES PATENT AND TRADEMARK OFFICE

CERTIFICATE OF CORRECTION

PATENT NO. : 4,745,367

DATED : May 17, 1988

INVENTOR(S) : Dustmann et al

It is certified that error appears in the above-identified patent and that said Letters Patent are hereby corrected as shown below:

In Column 7, line 62,

". . . current distribution $I(\theta)=I_{\theta}\cos n\,\theta$, where"

should read"

". . . current distribution $I(\theta)=I_{0}\cos n\,\theta$, where"

In Column 7, last line,

"conductiing winding . . ."

should read:

"conducting winding . . ."

In Column 8, line 4,

"with said at lest one . . . "

should read:

"with said at least one . . . ".

Signed and Sealed this

Thirteenth Day of December, 1988

*Attest:*

DONALD J. QUIGG

*Attesting Officer*

*Commissioner of Patents and Trademarks*